US010644454B2

(12) United States Patent
Zhou et al.

(10) Patent No.: US 10,644,454 B2
(45) Date of Patent: May 5, 2020

(54) DIFFERENTIAL CONNECTOR AND DIFFERENTIAL PAIR ARRANGEMENT STRUCTURE THEREOF AND DIFFERENTIAL CONNECTOR PLUG

(71) Applicant: AVIC JONHON OPTRONIC TECHNOLOGY CO., LTD, Henan (CN)

(72) Inventors: Guoqi Zhou, Henan (CN); Lufei Ma, Henan (CN); Junfeng Yuan, Henan (CN)

(73) Assignee: AVIC JONHON OPTRONIC TECHNOLOGY CO., LTD, Henan (CN)

( * ) Notice: Subject to any disclaimer, the term of this patent is extended or adjusted under 35 U.S.C. 154(b) by 0 days.

(21) Appl. No.: 16/301,740

(22) PCT Filed: Mar. 21, 2017

(86) PCT No.: PCT/CN2017/077548
§ 371 (c)(1),
(2) Date: Nov. 15, 2018

(87) PCT Pub. No.: WO2018/098939
PCT Pub. Date: Jul. 6, 2018

(65) Prior Publication Data

US 2019/0181591 A1 Jun. 13, 2019

(30) Foreign Application Priority Data

Nov. 30, 2016 (CN) ..... 2016 1 1082935

(51) Int. Cl.
*H01R 9/03* (2006.01)
*H01R 13/6463* (2011.01)
(Continued)

(52) U.S. Cl.
CPC ..... *H01R 13/6463* (2013.01); *H01R 13/514* (2013.01); *H01R 13/6467* (2013.01); *H01R 12/724* (2013.01); *H01R 13/6581* (2013.01)

(58) Field of Classification Search
CPC ..... H01R 13/6463; H01R 13/514; H01R 12/724; H01R 13/6467; H01R 13/6581; H01R 13/658
(Continued)

(56) References Cited

U.S. PATENT DOCUMENTS 7,883,367 B1 2/2011 Kline
8,905,786 B2 12/2014 Davis et al.
(Continued)

FOREIGN PATENT DOCUMENTS

CN 2519434 10/2002
CN 102969621 3/2013
(Continued)

OTHER PUBLICATIONS

"Search Report of Europe Counterpart Application", dated Jun. 18, 2019, pp. 1-2.
(Continued)

*Primary Examiner* — Abdullah A Riyami
*Assistant Examiner* — Nelson R. Burgos-Guntin
(74) *Attorney, Agent, or Firm* — JCIPRNET

(57) ABSTRACT

A differential connector and a differential pair arrangement structure thereof and a differential connector plug, and relates to the field of electric connectors. The differential connector plug includes: two or more signal modules stacked up in a layered manner, wherein the signal modules are combined two by two to form signal module pairs, two signal modules of the same signal module pair respectively form a first signal module and a second signal module, at least one differential pair of the first signal module and at
(Continued)

least one differential pair of the second signal module are respectively a first differential pair and a second differential pair, differential pair contact elements of the first differential pair and the second differential pair are respectively a first differential pair contact element and a second differential pair contact element, and projections, in the layered direction of the first signal module and the second signal module, of at least one of two first differential pair contact elements of at least one first differential pair and at least one of two second differential pair contact elements of at least one second differential pair have a point of intersection. The differential connector plug does not need to be additionally provided with a shielding plate, is simple in structure, and solves the problems of low assembly efficiency and high processing cost caused by complicated structure of existing differential connectors.

17 Claims, 8 Drawing Sheets

(51) Int. Cl.
*H01R 13/514* (2006.01)
*H01R 13/6467* (2011.01)
*H01R 13/6581* (2011.01)
*H01R 12/72* (2011.01)

(58) Field of Classification Search
USPC ..... 439/607.01, 607.07, 607.09, 607.11, 941
See application file for complete search history.

(56) References Cited

U.S. PATENT DOCUMENTS

| | | | | |
|---|---|---|---|---|
| 9,240,644 | B2 * | 1/2016 | Cohen | H01R 13/20 |
| 9,257,778 | B2 | 2/2016 | Buck et al. | |
| 9,774,144 | B2 * | 9/2017 | Cartier, Jr. | H01R 13/6585 |
| 2006/0216969 | A1 | 9/2006 | Bright et al. | |
| 2010/0035454 | A1 | 2/2010 | Morgan et al. | |
| 2014/0057494 | A1 | 2/2014 | Cohen | |

FOREIGN PATENT DOCUMENTS

| | | |
|---|---|---|
| CN | 103036110 | 4/2013 |
| CN | 104466539 | 3/2015 |
| CN | 104685729 | 6/2015 |
| CN | 102969621 | 3/2016 |
| EP | 2985841 | 2/2016 |
| WO | 2010025214 | 3/2010 |

OTHER PUBLICATIONS

"International Search Report (Form PCT/ISA/210)", dated Sep. 12, 2017, with English translation thereof, pp. 1-4.
"Office Action of Japan Counterpart Application," dated Nov. 26, 2019, p. 1-4.

* cited by examiner

DIFFERENTIAL CONNECTOR AND DIFFERENTIAL PAIR ARRANGEMENT STRUCTURE THEREOF AND DIFFERENTIAL CONNECTOR PLUG

CROSS-REFERENCE TO RELATED APPLICATION

This application is a 371 application of International PCT application serial no. PCT/CN2017/077548, filed on Mar. 21, 2017, which claims the priority benefit of China application no. 201611082935.4, filed on Nov. 30, 2016. The entirety of each of the abovementioned patent applications is hereby incorporated by reference herein and made a part of this specification.

BACKGROUND OF THE INVENTION

1. Field of the Invention

The present invention relates to the field of electric connectors, and particularly relates to a differential connector and a differential pair arrangement structure thereof and a differential connector plug.

2. Description of Related Art

An existing differential electric connector is mainly configured for high-speed and high-quality signal transmission, mainly comprising a shell and a signal module. The signal module comprises an insulator and a contact element fixed on the insulator, wherein the contact element comprises a differential pair and a grounded contact element, and one differential connector comprises at least two signal modules.

Taking a differential connector disclosed by Chinese patent with publication number of CN102969621B and publication date of 2016.03.23 as an example, the differential connector is equivalent to a differential connector plug, wherein the differential connector comprises at least two signal modules which are stacked up in a layered manner, each signal module comprises an insulated matrix and a differential pair and a grounded contact element which are assembled in the insulated matrix, the differential pair comprises two differential pair contact elements, projections, along the layered direction of the signal modules, of the differential pair contact elements of the differential pair of each signal module are overlapped, and the differential pair arrangement structure of such structure is easily interfered by outside signals.

SUMMARY OF THE INVENTION

Accordingly, the present invention is directed to a differential connector plug, so as to solve the problem that the existing differential connector plug is easily affected by outside signal; in addition, the present invention is further directed to a differential connector using the abovementioned differential connector plug and a differential pair arrangement structure used by the differential connector.

In order to achieve the abovementioned objectives, a first technical scheme of the differential connector plug of the present invention is that: the differential connector plug comprises two or more signal modules which are stacked up in a layered manner, the signal modules comprise differential pairs, the differential pair comprises two differential pair contact elements, the signal modules are combined two by two to form signal module pairs, one of two signal modules of the same signal module pair forms a first signal module, the other forms a second signal module, at least one differential pair of the first signal module is a first differential pair, differential pair contact elements of the first differential pair are first differential pair contact elements, at least one differential pair of the second signal module is a second differential pair, and differential pair contact elements of the second differential pair are second differential pair contact elements; and the first signal module and the second signal module of at least one signal module meet the following condition: projections, in the layered direction of the first signal module and the second signal module, of at least one of two first differential pair contact elements of at least one first differential pair and at least one of two second differential pair contact elements of at least one second differential pair have a point of intersection.

A second technical scheme of the differential connector plug of the present invention is that: for the differential connector plug according to the first technical scheme of the differential connector plug of the present invention, in a same signal module pair, the first signal module and the second signal module are arranged adjacently.

A third technical scheme of the differential connector plug of the present invention is that: for the differential connector plug according to the second technical scheme of the differential connector plug of the present invention, the first signal module and the second signal module are arranged alternately.

A fourth technical scheme of the differential connector plug of the present invention is that: for the differential connector plug according to the third technical scheme of the differential connector plug of the present invention, the first signal modules and the second signal modules are respectively formed by odd layers of signal modules and even layers of signal modules of the differential connector plug, structures of the odd layers of signal modules are the same, and structures of the even layers of signal modules are the same.

A fifth technical scheme of the differential connector plug of the present invention is that: for the differential connector plug according to any one of the first to the fourth technical schemes of the differential connector plug of the present invention, in a same signal module pair, projections, in the layered direction of the first signal module and the second signal module, of two first differential pair contact elements in at least one first differential pair both have points of intersection with those of the second differential pair contact elements.

A sixth technical scheme of the differential connector plug of the present invention is that: for the differential connector plug according to any one of the first to the fourth technical schemes of the differential connector plug of the present invention, in a same signal module pair, the projections, in the layered direction of the first signal module and the second signal module, of at least one second differential pair contact element have points of intersection with those of two or more first differential pair contact elements.

A seventh technical scheme of the differential connector plug of the present invention is that: for the differential connector plug according to any one of the first to the fourth technical schemes of the differential connector plug of the present invention, the first differential pairs and the second differential pairs in a same signal module pair are in one-to-one correspondence, and the point of intersections are formed on the projections, in the layered direction of the first signal module and the second signal module, of the corresponding differential pairs.

An eighth technical scheme of the differential connector plug of the present invention is that: for the differential connector plug according to any one of the first to the fourth technical schemes of the differential connector plug of the present invention, projections, in the layered direction of the first signal module and the second signal module, of the first differential pair contact element and the second differential pair contact element that have a point of intersection, form an X-shaped intersection.

A ninth technical scheme of the differential connector plug of the present invention is that: for the differential connector plug according to any one of the first to the fourth technical schemes of the differential connector plug of the present invention, projections, at the head part close to a plugging end and along the layered direction of the first signal module and the second signal module, of the first signal module and the second signal module of a same signal module pair have an overlapped part and/or projections, at the tail part far away from the plugging end and along the layered direction of the first signal module and the second signal module, of the first signal module and the second signal module in a same signal module pair have an overlapped part.

A tenth technical scheme of the differential connector plug of the present invention is that: for the differential connector plug according to any one of the first to the fourth technical schemes of the differential connector plug of the present invention, projections, in the layered direction of the first signal module and the second signal module, of one of two first differential pair contact elements in at least one first differential pair and one of two second differential pair contact elements in at least one second differential pair have at least two points of intersection.

A first technical scheme of the differential pair arrangement structure of the present invention is that: the differential pair arrangement structure comprises a first differential pair and a second differential pair which are arranged in a layered manner, the first differential pair includes two first differential pair contact elements, the second differential pair includes two second differential pair contact elements, projections, in the layered direction of the first signal module and the second signal module, of at least one of the two first differential pair contact elements and at least one of the two second differential pair contact elements have a point of intersection.

A second technical scheme of the differential pair arrangement structure of the present invention is that: for the differential pair arrangement structure according to the first technical scheme of the differential pair arrangement structure of the present invention, projections, in the layered direction of the first signal module and the second signal module, of the first differential pair and the second differential pair are in an X shape.

A third technical scheme of the differential pair arrangement structure of the present invention is that: for the differential pair arrangement structure according to the first technical scheme of the differential pair arrangement structure of the present invention, projections, in the layered direction of the first signal module and the second signal module, of one of the two first differential pair contact elements and one of the second differential pair contact elements have a point of intersection, and projections, in the layered direction of the first signal module and the second signal module, of the other one of the two first differential pair contact elements and the other one of the two second differential pair contact elements have a point of intersection.

A fourth technical scheme of the differential pair arrangement structure of the present invention is that: for the differential pair arrangement structure according to the first technical scheme of the differential pair arrangement structure of the present invention, projections, in the layered direction of the first signal module and the second signal module, of one of the two first differential pair contact elements have points of intersection with projections of both of the two second differential pair contact elements, and projections, in the layered direction of the first signal module and the second signal module, of the other one of the two first differential pair contact elements have a point of intersection with projection of one of the two second differential pair contact elements.

A fifth technical scheme of the differential pair arrangement structure of the present invention is that: for the differential pair arrangement structure according to the first technical scheme of the differential pair arrangement structure of the present invention, projections, in the layered direction of the first signal module and the second signal module, of at least one of the two first differential pair contact elements and one of the second differential pair contact elements have at least two points of intersection.

A first technical scheme of the differential connector of the present invention is that: the differential connector comprises a differential connector socket and a differential connector plug, the differential connector plug comprises two or more signal modules stacked up in a layered manner, each signal module comprises a differential pair, each differential pair comprises two differential pair contact elements, the signal modules are combined two by two to form signal module pairs, one of two signal modules in a same signal module pair forms a first signal module, the other forms a second signal module, at least one differential pair of the first signal module is a first differential pair, the differential pair contact elements of the first differential pair are first differential pair contact elements, at least one differential pair of the second signal module is a second differential pair, and the differential pair contact elements of the second differential pair are second differential pair contact elements; and the first signal module and the second signal module of the at least one signal module pair meet the following conditions: projections, in the layered direction of the first signal module and the second signal module, of at least one of the two first differential pair contact elements of the at least one first differential pair and at least one of the two second differential pair contact elements of the at least one second differential pair have a point of intersection.

A second technical scheme of the differential connector of the present invention is that: for the differential connector according to the first technical scheme of the differential connector of the present invention, in a same signal module pair, the first signal module and the second signal module are arranged adjacently.

A third technical scheme of the differential connector of the present invention is that: for the differential connector according to the second technical scheme of the differential connector of the present invention, the first signal module and the second signal module are arranged alternately.

A fourth technical scheme of the differential connector of the present invention is that: for the differential connector according to the third technical scheme of the differential connector of the present invention, the first signal modules and the second signal modules are respectively formed by odd layers of signal modules and even layers of signal modules of the differential connector plug, structures of the odd layers of signal modules are the same, and structures of the even layers of signal modules are the same.

A fifth technical scheme of the differential connector of the present invention is that: for the differential connector according to any one of the first to the fourth technical schemes of the differential connector of the present invention, in a same signal module pair, the projections, in the layered direction of the first signal module and the second signal module, of two first differential pair contact elements of at least one first differential pair both have points of intersection with those of the second differential pair contact elements.

A sixth technical scheme of the differential connector of the present invention is that: for the differential connector according to any one of the first to the fourth technical schemes of the differential connector of the present invention, in a same signal module pair, the projections of at least one second differential pair contact element, in the layered direction of the first signal module and the second signal module, have points of intersection with those of two or more first differential pair contact elements.

A seventh technical scheme of the differential connector of the present invention is that: for the differential connector according to any one of the first to the fourth technical schemes of the differential connector of the present invention, the first differential pairs and the second differential pairs in a same signal module pair are in one-to-one correspondence, and the point of intersection is formed on the projections, in the layered direction of the first signal module and the second signal module, of the corresponding differential pairs.

An eighth technical scheme of the differential connector of the present invention is that: for the differential connector according to any one of the first to the fourth technical schemes of the differential connector of the present invention, projections, in the layered direction of the first signal module and the second signal module, of the first differential pair contact element and the second differential pair contact element that have a point of intersection form an X-shaped intersection.

A ninth technical scheme of the differential connector of the present invention is that: for the differential connector according to any one of the first to the fourth technical schemes of the differential connector of the present invention, projections, at the head part close to a plugging end and along the layered direction of the first signal module and the second signal module, of the first signal module and the second signal module of a same signal module pair have an overlapped part and/or projections, at the tail part far away from the plugging end and along the layered direction of the first signal module and the second signal module, of the first signal module and the second signal module in a same signal module pair have an overlapped part.

A tenth technical scheme of the differential connector of the present invention is that: for the differential connector according to any one of the first to the fourth technical schemes of the differential connector of the present invention, projections, in the layered direction of the first signal module and the second signal module, of one of two first differential pair contact elements in at least one first differential pair and one of two second differential pair contact elements in at least one second differential pair in a same signal module have at least two points of intersection.

Beneficial effects of the present invention are as follows: in at least one signal module pair of the differential connector plug of the present invention, a first signal module and a second signal module in a same signal module pair meet the following conditions: projections, in the layered direction of the first signal module and the second signal module, of at least one of two first differential pair contact elements of at least one first differential pair and at least one of two second differential pair contact elements of the at least one second differential pair have a point of intersection. According to a twisted-pair electromagnetic shielding principle, for the differential pairs of the first signal module and the second signal module, in the signal transmission process, differential pair contact elements with projections in the layered direction of the first differential pair and the second differential pair having a point of intersection form two closed loops spatially, and when interference exists, directions of magnetic fields formed by an interference signal in the two loops are opposite, the two magnetic fields offset each other, and the differential pair contact elements with projections in the layered direction of the first signal module and the second signal module having a point of intersection automatically shield the interference signal. Compared with existing differential connector plugs, the differential pairs of the differential connector plug disclosed by the present invention can shield the interference signal, and therefore, the problem that the existing differential connector plug is easily interfered by outside signals is solved.

BRIEF DESCRIPTION OF THE DRAWINGS

FIG. 15 is a schematic diagram of projections, along the layered direction of the signal modules, of two groups of first differential pairs and second differential in a same signal module pair according to a specific embodiment 11 of the differential connector plug of the present invention.

DESCRIPTION OF THE EMBODIMENTS

Figure 1:
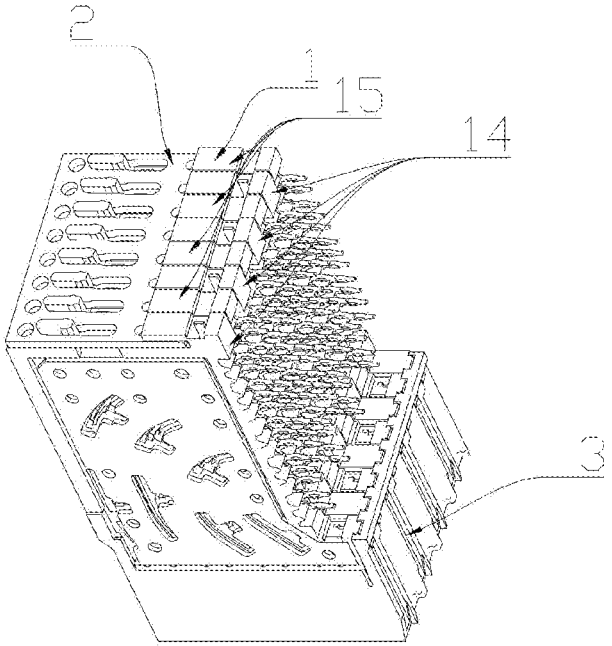
FIG. 1 is a structure schematic diagram according to a specific embodiment 1 of the differential connector plug of the present invention.
Figure 2:
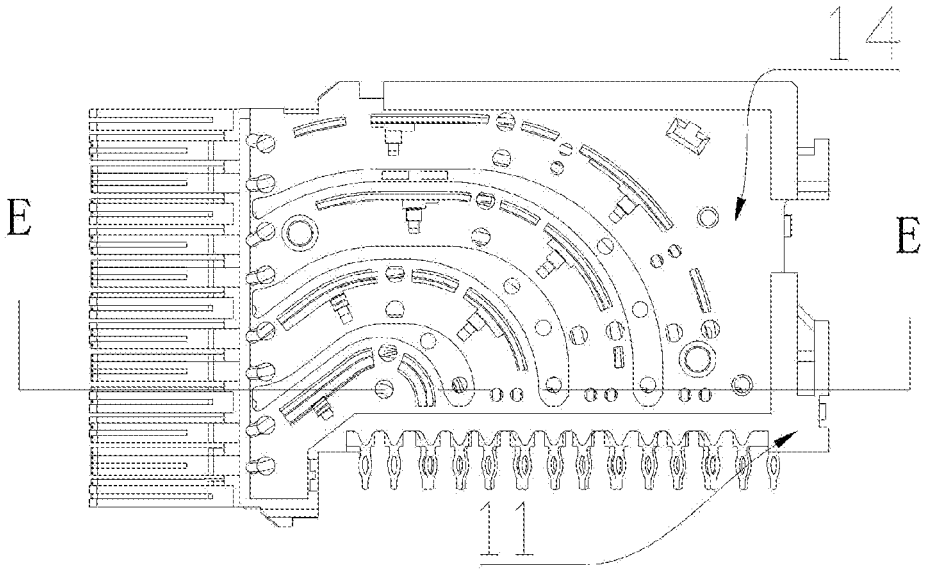
FIG. 2 is a structure schematic diagram of two signal modules which are stacked up according to the specific embodiment 1 of the differential connector plug of the present invention.
Figure 3:
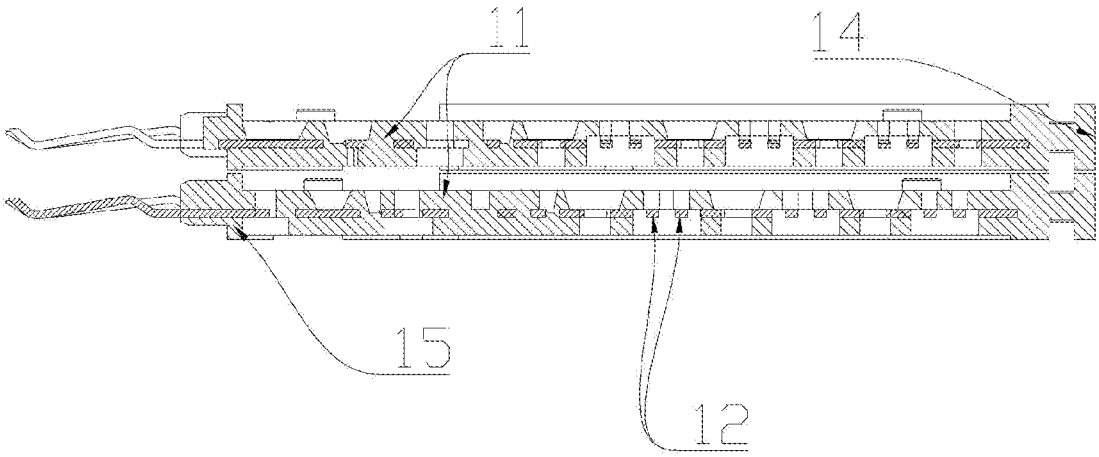
FIG. 3 is a cross-sectional view along E-E of FIG. 2.

Further illustrations will be made for the implementation manner of the present invention in combination with the drawings.

According to a specific embodiment of the differential connector plug of the present invention, as shown in FIGS. 1-5, the differential connector plug comprises eight signal modules 1 which are stacked up in a layered manner along the forward and backward directions, and the signal modules 1 are stacked on a plug shell 3 by a fixing piece 2. The signal module 1 comprises a moulding insulator 11, differential pairs 12 and grounded contact elements 13 are assembled in the moulding insulator 11, the grounded contact elements 13 and the differential pairs 12 are arranged at intervals, each differential pair 12 is clamped between the grounded contact elements 13 at two sides of the differential pair, and each differential pair comprises two differential pair contact elements. As shown in drawings, projections, in the forward and backward direction, of the differential contact elements of adjacent signal modules are in an X shape.

The signal modules 1 are combined two by two to form signal module pairs, one of two signal modules in a same signal module pair forms a first signal module, the other one forms a second signal module, the first signal module comprises four first differential pairs, each first differential pair comprises two first differential pair contact elements, the second signal module comprises four second differential pairs, and each second differential pair comprises two second differential pair contact elements. In the present embodiment, the first differential pairs and the second differential pairs are in one-to-one correspondence, not only in quantity, but also in spatial space, differential pairs of a same signal module in the present embodiment are divided into four grades along the differential pair arrangement direction, and the differential pairs of the same grade in a same signal module correspond to each other. One of two adjacent signal modules 1 is an odd layer of signal module, and the other one is an even layer of signal module, the odd layer of signal module forms a first signal module 14, the even layer of signal module forms a second signal module 15, correspondingly, the first differential pair is formed by differential pairs of the odd layer of signal module, the second differential pair is formed by differential pairs of the even layer of signal module, each first differential pair contact element 141 is formed by differential pair contact elements of the odd layer of signal module, and each second differential pair contact element 151 is formed by differential pair contact elements of the even layer of signal module. The signal module pairs in the present embodiment are not limited to specific two signal modules, for example, three adjacent signal modules can form two signal module pairs, and the signal module in the middle is a common signal module of the other two signal module pairs. In other embodiments, the signal module pairs may not be adjacent signal modules, for example, they may be signal module pairs formed by two odd layers of signal modules, or may also be signal module pairs formed by an odd layer of signal module and a nonadjacent even layer of signal module.

Figure 4:
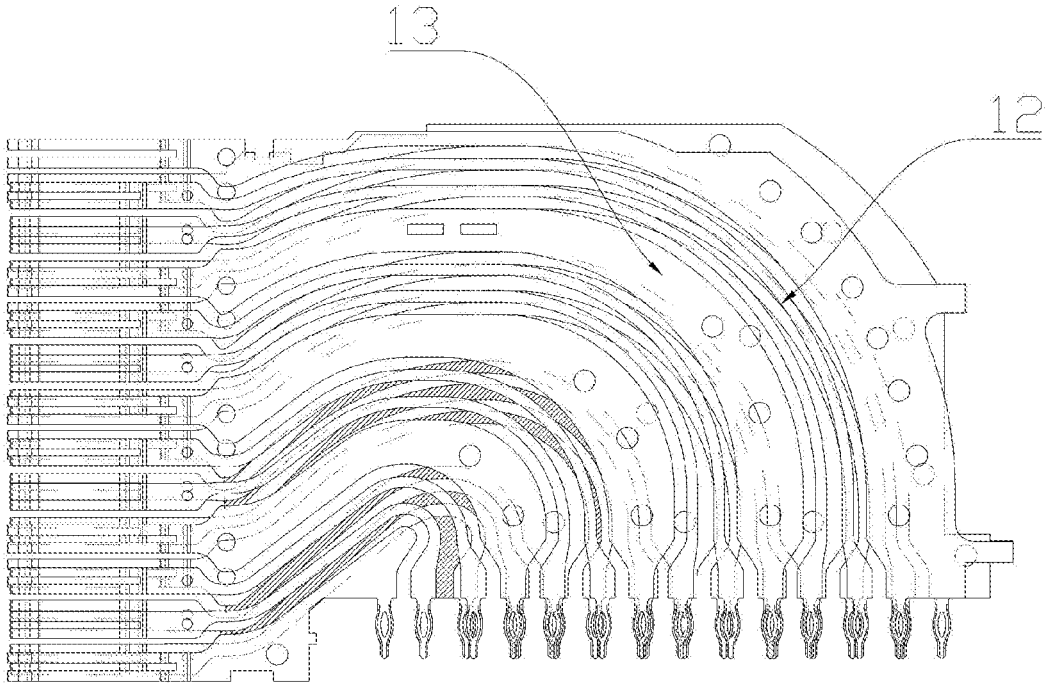
FIG. 4 is a structure schematic diagram in which the differential pair and the grounded contact element of a same signal module pair are stacked up according to the specific embodiment 1 of the differential connector plug of the present invention.
Figure 5:
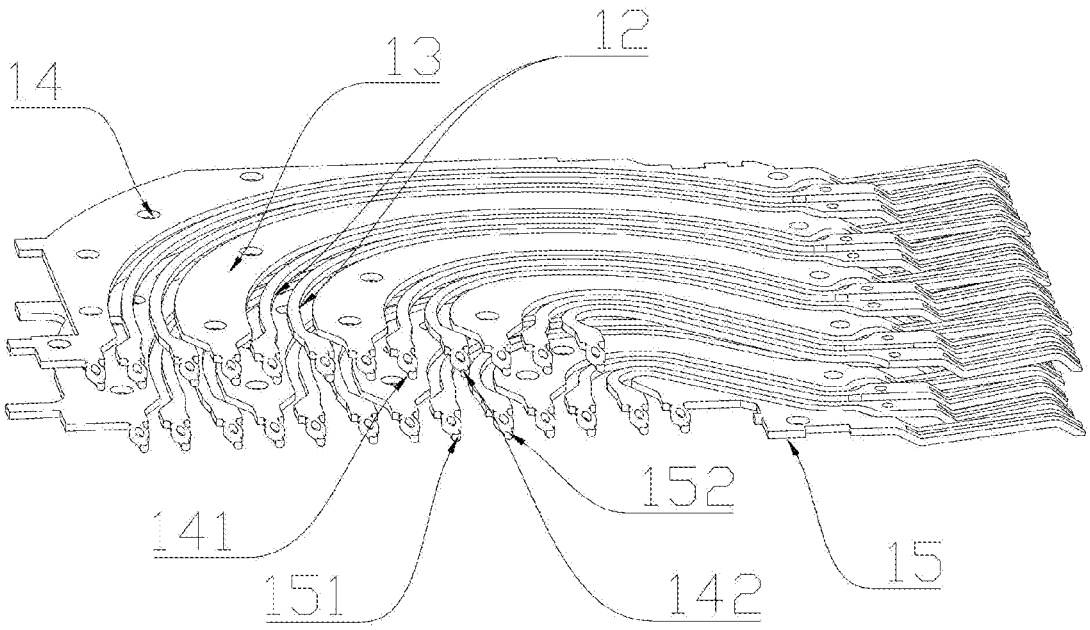
FIG. 5 is a structure schematic diagram of the differential pair and the grounded contact element of a same signal module pair according to the specific embodiment 1 of the differential connector plug of the present invention.

As shown in FIG. 4, projections, at the head part close to a plugging end and along the layered direction of the first signal module and the second signal module, of the first signal module and the second signal module of a same signal module pair have an overlapped part; projections, at the tail part far away from the plugging end and along the layered direction of the first signal module and the second signal module, of the first signal module and the second signal module in a same signal module pair have an overlapped part, so as to reduce the volume of the differential connector plug as far as possible.

Figure 9:
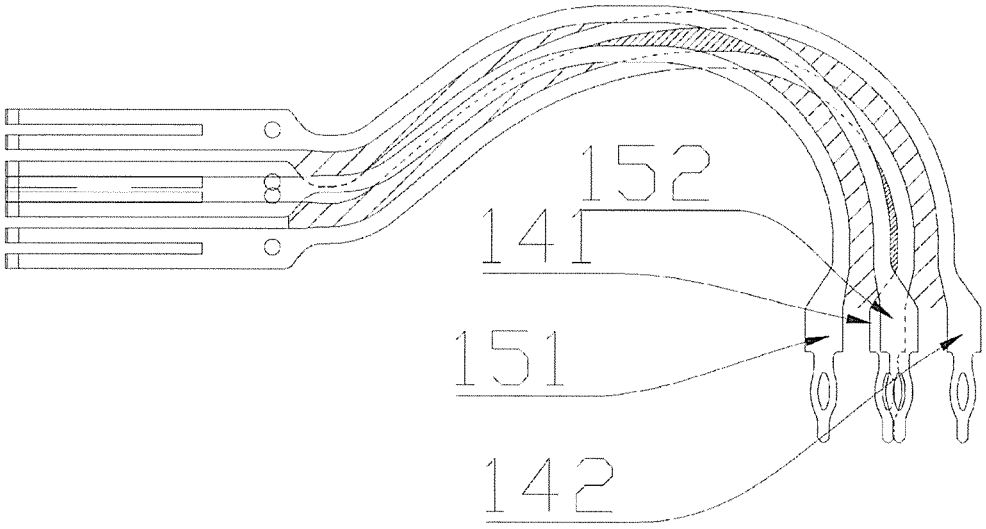
FIG. 9 is a closed loop formed by a first differential pair and a second differential pair of a same signal module pair according to the specific embodiment 1 of the differential connector plug of the present invention.

In the present embodiment, in each signal module pair, the first signal module and the second signal module in a same signal module pair meet the following conditions: as shown in FIG. 9, projections, in the layered direction of the first signal module and the second signal module, of one of the two first differential pair contact elements of the first differential pair have points of intersection with both of those of two second differential pair contact elements of the corresponding second differential pair, and projections, in the layered direction of the first signal module and the second signal module, of the other one of the two first differential pair contact elements of the first differential pair have a point of intersection with that of one of the two second differential pair contact elements of the corresponding second differential pair. The first and second differential pair contact elements that have points of intersection form an X-shaped intersection.

The structures of the contact elements of each odd layer of signal module are the same, and the projections, along the layered direction of the signal modules, of the contact elements are overlapped; and the structures of the contact elements of each even layer of signal module are the same, and projections, along the forward and backward direction, of the contact elements are overlapped, so as to facilitate processing.

Figure 6:
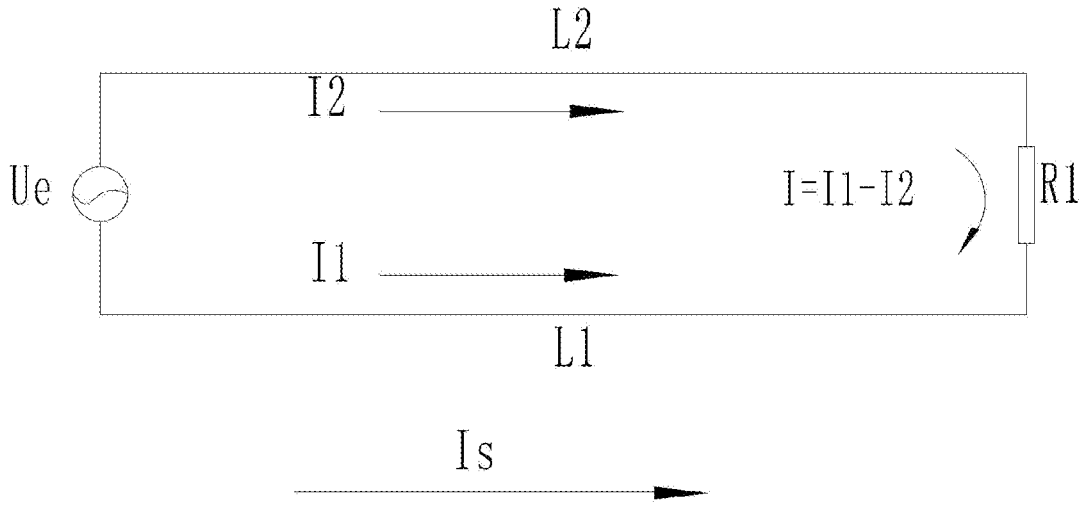
FIG. 6 is an interfering principle schematic diagram of an interference signal to parallel lines.

FIG. 6 is an interfering principle schematic diagram of an interference signal to parallel lines, and interference currents generated by interference current Is on two guide lines L1 and L2 of a dual-line are respectively I1 and I2. Because L1 is closer to an interference source, so I1>I2, I=I1≠0, and interference current exists.

Figure 7:
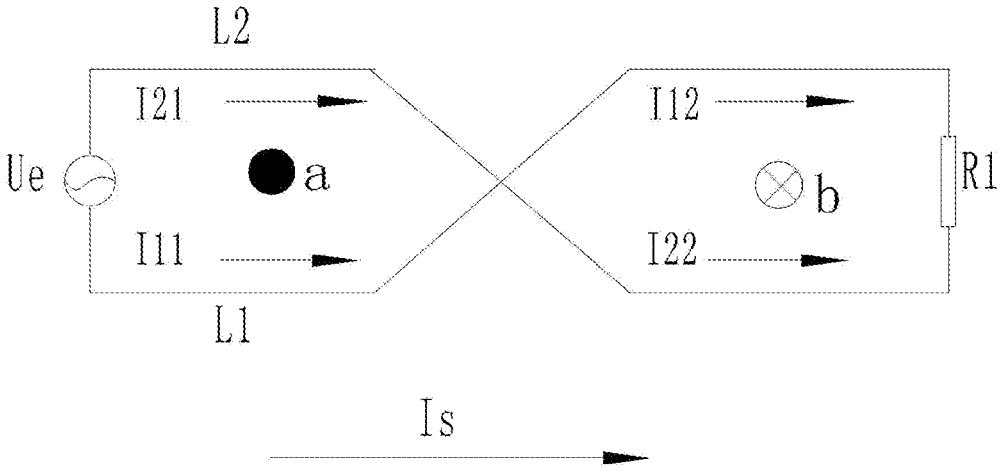
FIG. 7 is a principle schematic diagram of a twisted-pair electromagnetic shielding interfering signals.

While in a twisted pair, as shown in FIG. 7, what is different from FIG. 6 is that twisting is performed once on the midpoint position of a twisted-pair loop. Interference current I11 and I12 exist on L1, interference current I21 and I22 exist on L2, interference current I=I11+I22−I21−I12, when conditions of lines at two ends are the same, the total interference current I=0, and therefore, interference can be eliminated as long as reasonable pitch is set. Interference Is forms magnetic fields with same size and opposite directions in the spatial loop a and loop b, and the magnetic fields of the two loops offset each other.

Signal modules of the differential connector plug of the present invention are stacked up along the layered direction of the signal modules, projections, in the forward and backward direction, of differential pairs of adjacent signal modules are intersected, and two first differential pair contact elements of the first signal module have points of intersection with two second differential pair contact elements of the corresponding second signal module. According to a twisted-pair electromagnetic shielding principle, for the differential pairs of the first signal module and the second signal module, in the signal transmission process, the first differential pair contact elements and the second differential pair contact elements, with projections in the layered direction of the signal modules intersected, form two closed loops spatially, and when interference exists, magnetic fields formed by an interference signal in the two loops are opposite in directions, the two magnetic fields offset each other, and the first differential pair contact elements and the second differential pair contact elements, with projections in the layered direction of the signal modules intersected, automatically shield the interference signal.

Figure 8:
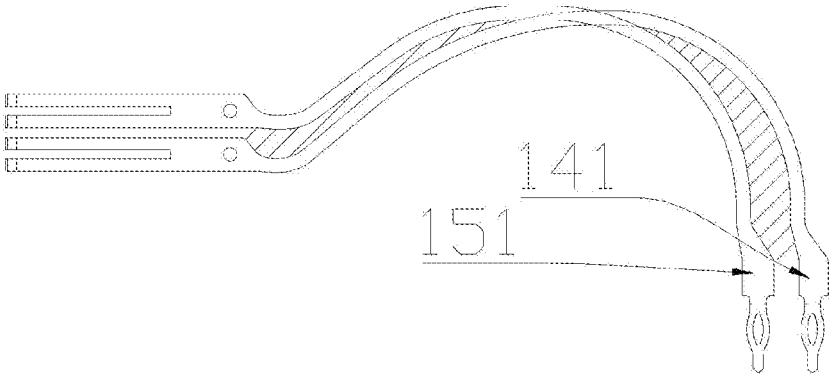
FIG. 8 is a schematic diagram of a closed loop formed by single differential pair contact elements of a same signal module pair according to the specific embodiment 1 of the differential connector plug of the present invention.

A closed loop formed by a single first differential pair contact element and a single second differential pair contact element is as shown in FIG. 8, the first signal module 14 and the second signal module 15 are arranged adjacently, the first differential pair contact elements 141 and the second differential pair contact elements 151 are arranged in an intersected manner, two closed spatial loops are formed in the signal transmission process, and when interference exists, magnetic fields formed by an interference signal in the two loops are opposite in directions, and the magnetic fields offset each other.

FIG. 9 is a structure schematic diagram of a first differential pair and a corresponding second differential pair, and projections, in the layered direction of the first signal module and the second signal module, of the first differential pair contact element 141 and a first differential pair contact element 142 have points of intersection with those of a second differential pair contact element 151 and a second differential pair contact element 152. The first differential pair contact element 141 and the first differential pair contact element 142 are both spatially intersected with the second differential pair contact element 152, and projections, in the layered direction of the signal module and the second signal module, of the first differential pair contact element 141 and the first differential pair contact element 142 have points of intersections with that of the second differential pair contact element 152; projections, in the layered direction of the first signal module and the second signal module, of the first differential pair contact element 141 and the second differential pair contact element 151 have a point of intersection. Therefore, in the signal transmission process, a closed loop will be formed. The shaded area in FIG. 9 is an area generating a magnetic field of the closed loop. Adjacent signal module contact elements are arranged in an intersected manner, and the contact elements 141 and 142 and the contact elements 151 and 152 are corresponding pairs of differential pairs. The whole differential connector plug will form a plurality of spatial closed loops.

Compared with the existing differential connector that shields the interference signal by arranging a shielding board, the differential connector disclosed by the present invention shields the interference signal by the arrangement of the differential pairs, so the structure is simple. In other embodiments, in order to further enhance the shielding effect of the differential connector, a shielding board may also be arranged between adjacent signal modules.

Figure 10:
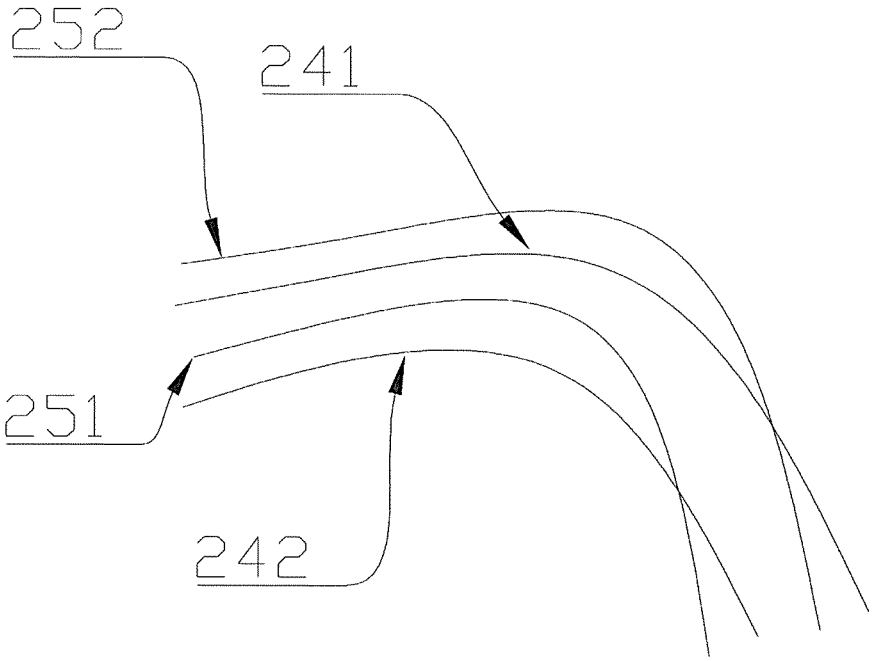
FIG. 10 is a schematic diagram of projections, along the layered direction of the signal modules, of a group of first differential pair and second differential pair in a same signal module pair according to a specific embodiment 2 of the differential connector plug of the present invention.

According to a specific embodiment 2 of the differential connector plug of the present invention, the difference between the present embodiment and the abovementioned embodiment 1 is only that: as shown in FIG. 10, in a group of first differential pair and second differential pair corresponding to the first differential pair of a same signal module, projections, in the layered direction of the first signal module and the second signal module, of a first differential pair contact element 241 of two first differential pair contact elements and a second differential pair contact element 251 of two second differential pair contact elements have a point of intersection, and projections, in the layered direction of the first and second signal modules, of a first differential pair contact element 242 of the two first differential pair contact elements and a second differential pair contact element 252 of the two second differential pair contact elements have a point of intersection.

Figure 11:
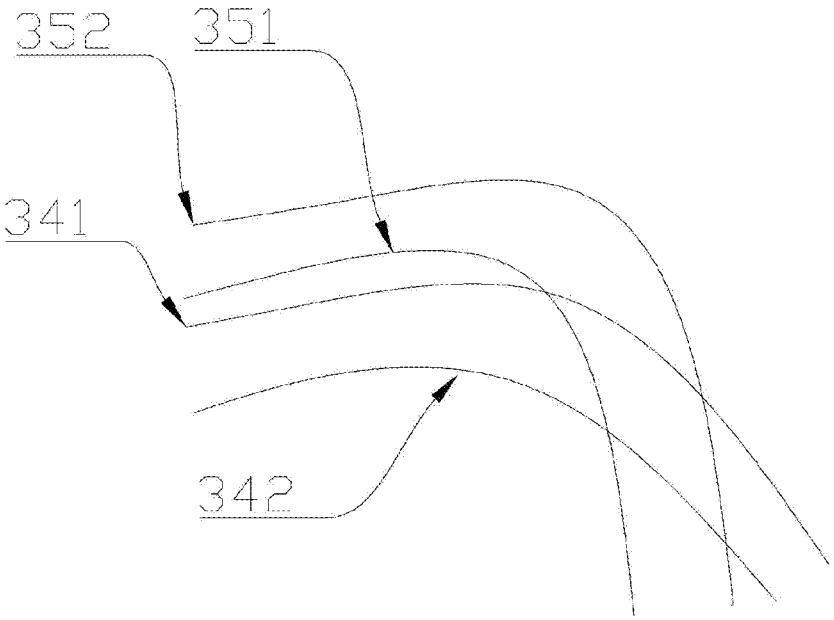
FIG. 11 is a schematic diagram of projections, along the layered direction of the signal modules, of a group of first differential pair and second differential pair in a same signal module pair according to a specific embodiment 3 of the differential connector plug of the present invention.

According to a specific embodiment 3 of the differential connector plug of the present invention, the difference between the present embodiment and the abovementioned embodiment 1 is only that: as shown in FIG. 11, in a group of first differential pair and second differential pair corresponding to the first differential pair of a same signal module, projections, in the layered direction of the first signal module and the second signal module, of a first differential pair contact element 341 of two first differential pair contact elements have points of intersection with those of both of two second differential pair contact elements 351 and 352; projections, in the layered direction of the first signal module and the second signal module, of a first differential pair contact element 342 of the two first differential pair contact elements also have points of intersection with those of both of the two second differential pair contact elements 351 and 352, and at the moment, the first differential pair and the second differential pair are in an X-shaped spatial intersection.

According to a specific embodiment 4 of the differential connector plug of the present invention, the difference between the present embodiment and the abovementioned embodiment 1 is only that: the quantities of differential pairs of the first signal module and the second signal module are not in one-to-one correspondence, one first differential pair corresponds to two second differential pairs, and projections, in the layered direction of the signal modules, of the corresponding first differential pairs and second differential pairs all have points of intersection.

Figure 12:
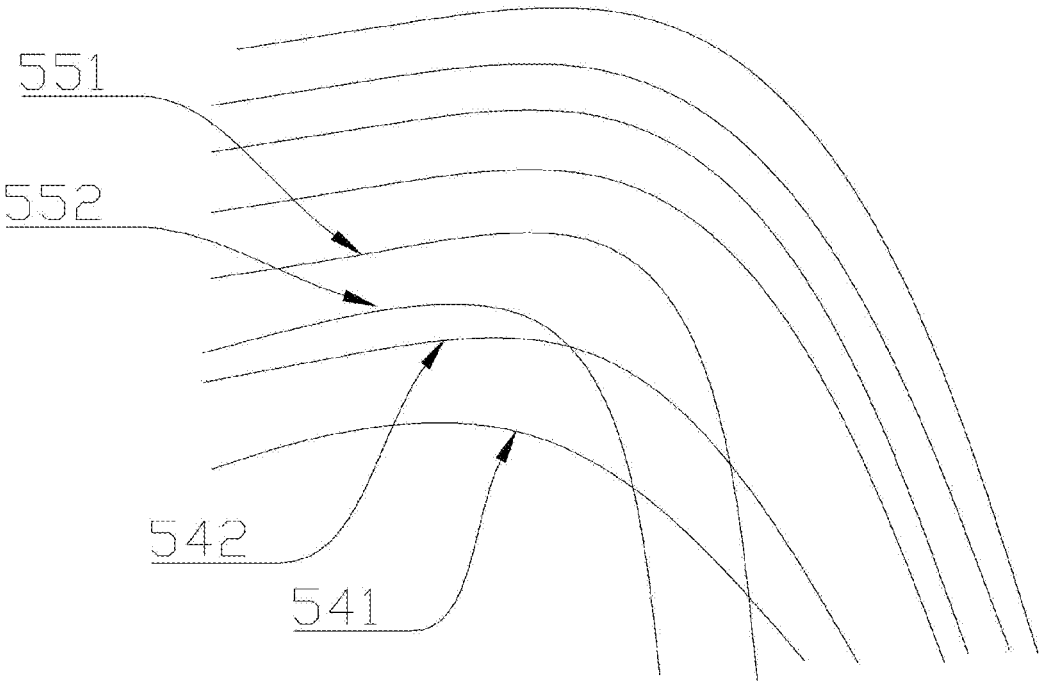
FIG. 12 is a schematic diagram of projections, along the layered direction of the signal modules, of two groups of first differential pairs and second differential pairs in a same signal module pair according to a specific embodiment 5 of the differential connector plug of the present invention.

According to a specific embodiment 5 of the differential connector plug of the present invention, the difference between the present embodiment and the abovementioned embodiment 1 is only that: as shown in FIG. 12, projections, in the layered direction of the signal modules, of first differential pair contact elements 541 and 542 and second differential pair contact elements 551 and 552 of only one pair of corresponding first differential pair and second differential pair in the first signal module and the second signal module have points of intersection.

Figure 13:
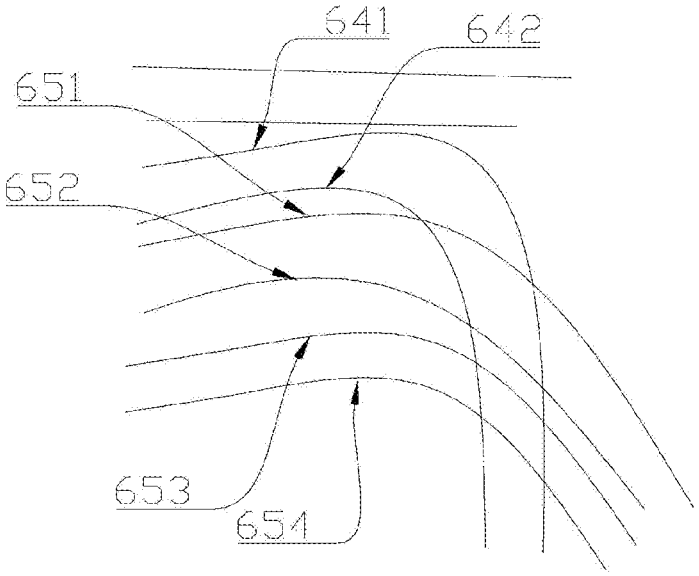
FIG. 13 is a schematic diagram of projections, along the layered direction of the signal modules, of two groups of first differential pairs and second differential pairs in a same signal module pair according to a specific embodiment 6 of the differential connector plug of the present invention.

According to a specific embodiment 6 of the differential connector plug of the present invention, the difference between the present embodiment and the abovementioned embodiment 1 is only that: as shown in FIG. 13, besides the fact that first differential pair contact elements 641 and 642 of a first differential pair have points of intersection with second differential pair contact elements 651 and 652 of the corresponding second differential pair, the first differential pair contact elements of the first differential pair also have points of intersection with the second differential pair contact elements 653 and 654 of another second differential pair adjacent to the corresponding second differential pair.

According to a specific embodiment 7 of the differential connector plug of the present invention, the difference between the present embodiment and the abovementioned embodiment 1 is only that: the first signal module and the second signal module of a same signal module pair are two spaced signal modules instead of adjacent signal modules.

According to a specific embodiment 8 of the differential connector plug of the present invention, the difference between the present embodiment and the abovementioned embodiment 1 is only that: projections, at the head part close to a plugging end and along the layered direction of the signal modules, of the first signal module and the second signal module of a same signal module pair are staggered, and projections, at the tail part far away from the plugging end and along the layered direction of the signal modules, of the first signal module and the second signal module of a same signal module pair are staggered.

Figure 14:
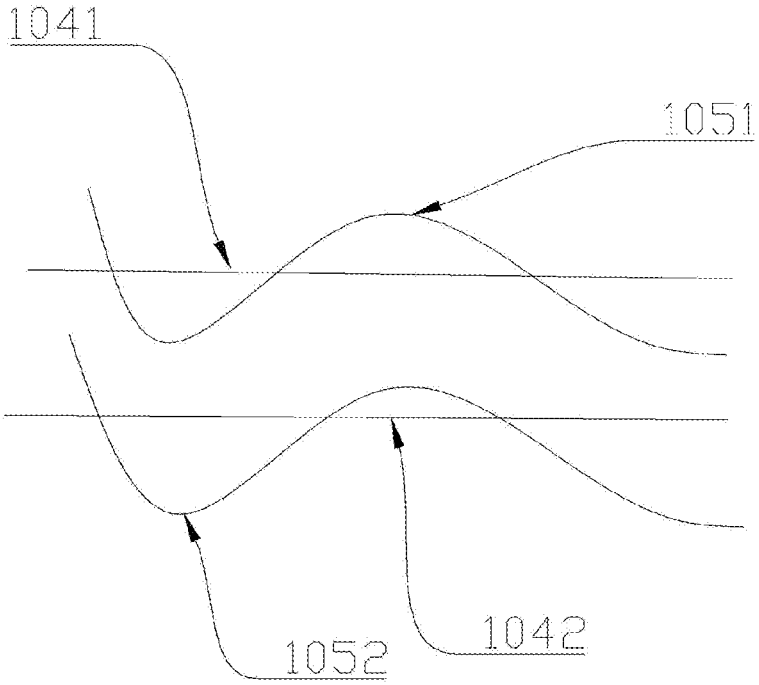
FIG. 14 is a schematic diagram of projections, along the layered direction of the signal modules, of a group of first differential pair and second differential pair in a same signal module pair according to a specific embodiment 9 of the differential connector plug of the present invention.

According to a specific embodiment 9 of the differential connector plug of the present invention, the difference between the present embodiment and the abovementioned embodiment 1 is only that: as shown in FIG. 14, for a same signal module pair, the quantity of points of intersection of projections, in the layered direction of the first signal module and the second signal module, of a first differential pair contact element 1041 of a first differential pair and a second differential pair contact element 1051 of a corresponding second differential pair is three, and the quantity of points of intersection of projections, in the layered direction of the first signal module and the second signal module, of a first differential pair contact element 1042 and a second differential pair contact element 1052 of the corresponding second differential pair is three.

According to a specific embodiment 10 of the differential connector plug of the present invention, the difference between the present embodiment and the abovementioned embodiment 1 is that: the quantity of points of intersection of projections, in the layered direction of the first signal module and the second signal module, of one of two first differential pair contact elements of multiple first differential pairs and one of two second differential pair contact elements of one second differential pair is three; and in other embodiments, the quantity of points of intersection of projections, in the layered direction of the first signal module and the second signal module, of one of two first differential pair contact elements of multiple first differential pairs and one of two second differential pair contact elements of multiple second differential pairs is three, and the quantity of points of intersection of projections, in the layered direction of the first signal module and the second signal module, of one of two first differential pair contact elements of one first differential pair and one of two second differential pair contact elements of multiple second differential pairs is three.

Figure 15:
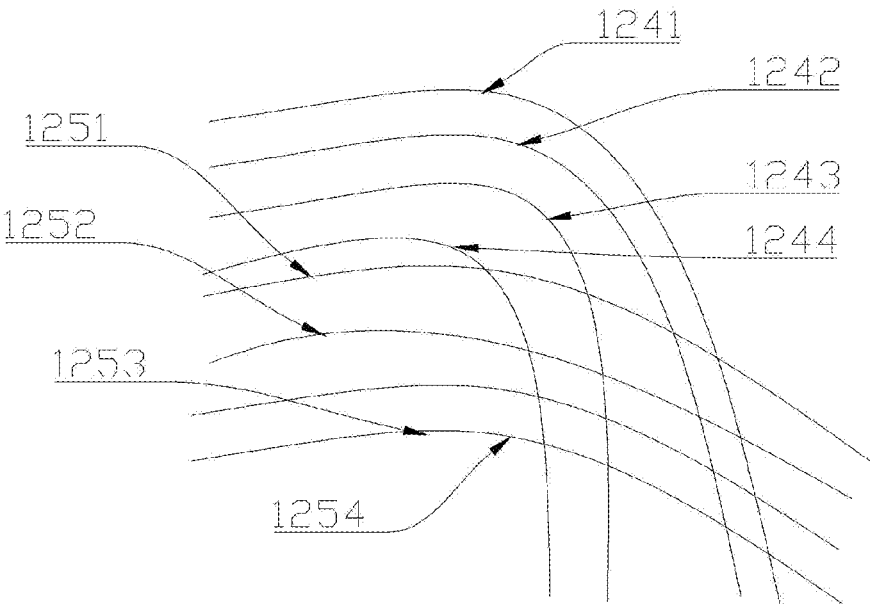
FIG. 15 is a schematic diagram of projections, along the layered direction of the signal modules, of two groups of first differential pairs and second differential pairs in a same signal module pair according to a specific embodiment 11 of the differential connector plug of the present invention.

According to a specific embodiment 11 of the differential connector plug of the present invention, the difference between the present embodiment and the abovementioned embodiment 1 is only that: as shown in FIG. 15, in a same signal module, two first differential pairs are spatially intersected with two second differential pairs respectively, and projections, in the layered direction of the signal modules, of first differential pair contact elements 1241, 1242, 1243 and 1244 all have points of intersection with second differential pair contact elements 1251, 1252, 1253 and 1254.

According to a specific embodiment of the differential connector of the present invention, the differential connector comprises a differential connector plug and a differential connector socket, and the structure of the differential connector plug is the same as that of the differential connector plug disclosed in any one of the specific embodiments 1-11 of the differential connector plug, and the descriptions thereof are omitted herein.

According to a specific embodiment of the differential pair arrangement structure of the present invention, the differential pair arrangement structure comprises first differential pairs and second differential pairs, which are arranged in a layered manner, and the structures of the first differential pairs and the second differential pairs are the same as those of any group of first differential pair and second differential pair of the differential connector plug disclosed in any one of the specific embodiments 1-11 of the differential connector plug, and the descriptions thereof are omitted herein.

In other embodiments of the differential connector and the differential pair arrangement structure thereof and the differential connector plug of the present invention, the quantity of points of intersection of the abovementioned correspondingly adjacent differential pair contact elements may be two, and at the moment, the bending curvature of the differential pair contact elements needs to be changed; two adjacent signal modules of the abovementioned signal modules may be both odd layer of signal modules or both even layer of signal modules, and at the moment, projections, in the forward and backward direction, of adjacent odd layer of signal modules or even layer of signal modules are intersected; in order to enhance the shielding performance of the differential connector, a shielding board may be arranged between adjacent signal modules.

What are described in the abovementioned embodiments are only detailed descriptions of a typical differential contact element arrangement manner, but on the basis of the twisted-pair electromagnetic shielding principle, implementation of self-shielding of the differential connector plug by different arrangement manners is not only limited to the manners of the abovementioned embodiments. In order to achieve the objective of self-shielding of the differential connector plug, all arrangement manners of the differential pair contact elements by utilizing the twisted-pair electromagnetic shielding principle fall within the scope of the claims of the present invention.

What is claimed is:

1. A differential connector plug, comprising: two or more signal modules stacked up in a layered manner, each signal module comprising differential pairs, each differential pair comprising two differential pair contact elements, and wherein the signal modules are combined two by two to form signal module pairs, one of two signal modules of the same signal module pair forms a first signal module, the other forms a second signal module, at least one differential pair of the first signal module is a first differential pair, differential pair contact elements of the first differential pair are first differential pair contact elements, at least one differential pair of the second signal module is a second differential pair, and differential pair contact elements of the second differential pair are second differential pair contact elements; and the first signal module and the second signal module of at least one signal module meeting the following condition: projections, in the layered direction of the first signal module and the second signal module, of at least one of two first differential pair contact elements of at least one first differential pair and at least one of two second differential pair contact elements of at least one second differential pair have a point of intersection, wherein in a same signal module pair, the projections, in the layered direction of the first signal module and the second signal module, of at least one second differential pair contact element have points of intersection with that of two or more first differential pair contact elements.

2. The differential connector plug according to claim 1, wherein in a same signal module pair, the first signal module and the second signal module are arranged adjacently.

3. The differential connector plug according to claim 2, wherein the first signal module and the second signal module are arranged alternately.

4. The differential connector plug according to claim 3, wherein the first signal modules and the second signal modules are respectively formed by odd layers of signal modules and even layers of signal modules of the differential connector plug, structures of the odd layers of signal modules are the same, and structures of the even layers of signal modules are the same.

5. The differential connector plug according to claim 1, wherein in a same signal module pair, projections, in the layered direction of the first signal module and the second signal module, of two first differential pair contact elements in at least one first differential pair both have points of intersection with that of the second differential pair contact elements.

6. The differential connector plug according to claim 1, wherein first differential pairs and second differential pairs in a same signal module pair are in one-to-one correspondence, and the point of intersections are formed on the projections, in the layered direction of the first signal module and the second signal module, of the corresponding differential pairs.

7. The differential connector plug according to claim 1, wherein projections, in the layered direction of the first signal module and the second signal module, of the first differential pair contact element and the second differential pair contact element that have a point of intersection form an X-shaped intersection.

8. The differential connector plug according to claim 1, wherein projections at a head part close to a plugging end and along the layered direction of the first signal module and the second signal module, of a first signal nodule and a second signal module of a same signal module pair have an overlapped part and/or projections, at a tail part far away from the plugging end and along the layered direction of the first signal module and the second signal module, of the first signal module and the second signal module of the same signal module pair have an overlapped part.

9. A differential pair arrangement structure, comprising a first differential pair and a second differential pair which are arranged in a layered manner, the first differential pair including two first differential pair contact elements, the second differential pair including two second differential pair contact elements, and wherein projections, in the layered direction of the first differential pair and the second differential pair, of at least one of the two first differential pair contact elements and at least one of the two second differential pair contact elements have a point of intersection, wherein in a same differential pair, the projections, in the layered direction of the first differential pair and the second differential pair, of at least one second differential pair contact element have points of intersection with that of two or more first differential pair contact elements.

10. A differential connector, comprising a differential connector socket and a differential connector plug, the differential connector plug comprising two or more signal modules stacked up in a layered manner, each signal module comprising differential pairs, each differential pair comprising two differential pair contact elements, and wherein the signal modules are combined two by two to form signal module pairs, one of two signal modules in a same signal module pair forms a first signal module, the other forms a second signal module, at least one differential pair of the first signal module is a first differential pair, differential pair contact elements of the first differential pair are first differential pair contact elements, at least one differential pair of the second signal module is a second differential pair, and differential pair contact elements of the second differential pair are second differential pair contact elements; and the first signal module and the second signal module of at least one signal module pair meeting the following conditions: projections, in the layered direction of the first signal module and the second signal module, of at least one of the two first differential pair contact elements of the at least one first differential pair and at least one of the two second differential pair contact elements of the at least one second differential pair have a point of intersection, wherein in a same signal module pair, the projections, in the layered direction of the first signal module and the second signal module, of at least one second differential pair contact element have points of intersection with that of two or more first differential pair contact elements.

11. The differential connector according to claim 10, wherein in a same signal module pair, the first signal module and the second signal module are arranged adjacently.

12. The differential connector according to claim 11, wherein the first signal module and the second signal module are arranged alternately.

13. The differential connector according to claim 12, wherein the first signal modules and the second signal modules are respectively formed by odd layers of signal modules and even layers of signal modules of the differential connector plug, structures of the odd layers of signal modules are the same, and structures of the even layers of signal modules are the same.

14. The differential connector according to claim 10, wherein in a same signal module pair, projections, in the layered direction of the first signal module and the second signal module, of two first differential pair contact elements in at least one first differential pair both have points of intersection with that of the second differential pair contact elements.

15. The differential connector according to claim 10, wherein the first differential pair and the second differential pair in a same signal module pair are in one-to-one correspondence, and the points of intersection are formed on the projections, in the layered direction of the first signal module and the second signal module, of the corresponding differential pairs.

16. The differential connector according to claim 10, wherein projections, in the layered direction of the first signal module and the second signal module, of the first differential pair contact element and the second differential pair contact element that have a point of intersection form an X-shaped intersection.

17. The differential connector according to claim 10, wherein projections, at a head part close to a plugging end and along the layered direction of the first signal module and the second signal module, of the first signal module and the second signal module of a same signal module pair have an overlapped part and/or projections, at a tail part far away from the plugging end and along the layered direction of the first signal module and the second signal module, of the first signal module and the second signal module of the same signal module pair have an overlapped part.

* * * * *